United States Patent [19]

Pittarello et al.

[11] Patent Number: 4,816,111

[45] Date of Patent: Mar. 28, 1989

[54] SYSTEM FOR PROCESSING FABRICS OR WEBS CONTINUOUSLY

[75] Inventors: Ferruccio Pittarello, Vicenza; Italo Pulina, Bassano Del Grappa, both of Italy

[73] Assignee: Nuova Isotex S.p.A., Altavilla VC, Italy

[21] Appl. No.: 781,825

[22] Filed: Sep. 30, 1985

[30] Foreign Application Priority Data

Oct. 11, 1984 [IT] Italy ..... 84957 A/84

[51] Int. Cl.[4] ..... B65H 19/08; B65H 18/16

[52] U.S. Cl. ..... 156/504; 156/507; 156/517; 156/583.1; 242/56 R; 242/58.3; 242/58.5

[58] Field of Search ..... 242/56 R, 58.1, 58.3, 242/58.5; 57/23, 32; 28/141, 169; 156/390, 504, 505, 159, 583.1, 502, 507; 34/153, 229, 160, 233

[56] References Cited

U.S. PATENT DOCUMENTS

| | | | |
|---|---|---|---|
| 3,817,467 | 6/1974 | Dambroth | 242/56 R |
| 4,010,911 | 3/1977 | Heitmann | 156/505 |
| 4,111,377 | 9/1978 | Tetro | 242/56 R |
| 4,284,463 | 8/1981 | Wright | 242/58.5 |
| 4,519,858 | 5/1985 | Martin | 156/504 |
| 4,609,162 | 9/1986 | Kataoka | 242/56 R |
| 4,612,080 | 9/1986 | Aivola | 242/58.5 |

*Primary Examiner*—David Simmons
*Assistant Examiner*—J. Davis
*Attorney, Agent, or Firm*—Guido Modiano; Albert Josif

[57] ABSTRACT

A system for processing fabrics or webs continuously, especially for applying and drying resins or other chemicals on glass fiber cloth. The system includes an upstream-located unwinding unit which comprises a semi-automatic splicing assembly for splicing the terminating or trailing end of a fabric or web coming from an unwound roll to the forward or leading end of a fabric or web on a roll to be unwound. The unwinding unit is followed by a first multiple turn-around and take-up roller set when the fabric or web is transferred to a station of application of a resin or other processing material. From the application station the fabric is fed to a hot air drying kiln, where the resin is dried. Downstream of the processing kiln, there are provided a hot finishing roll assembly followed by a second multiple turn-around and take-up roller set. Finally for the processed fabric or web is wound into a roll by a winding unit.

9 Claims, 8 Drawing Sheets

SYSTEM FOR PROCESSING FABRICS OR WEBS CONTINUOUSLY

BACKGROUND OF THE INVENTION

The present invention relates to a system for processing fabrics or webs continuously.

Known in the art have long been systems for impregnating fabrics or webs with a resin and then hot curing the resin. Such prior systems comprise, in general, a vat containing the resin to be applied in a liquid state, through which vat the fabric to be impregnated is caused to pass, and a kiln maintained at an adequate temperature through which the resin impregnated to the fabric is dried and cured. The fabric or web material to be impregnated is unwound from a roll of material and again wound into a roll after the treatment.

In order to operate on a continuous basis, it is necessary that the splicing of the trailing end or edge of an unwound roll of fabric or web to the leading end or edge of a fresh roll be effected rapidly and accurately, without the whole system requiring to be stopped to replace a feed roll upstream of the system. Like considerations also apply to the removal of a wound roll downstream of the whole system.

The web or fabric splicing, while posing problems of splice strength and holding power, is also to ensure true alignment of the two spliced fabrics or webs, if undesired stresses are to be avoided in the fabric which might result in breakage or tears due to misalignment over the support and deflector rolls through the system.

An unwinding assembly has already been proposed which is operative to splice together the ends of two webs or fabrics to be treated by interposing a suitable adhesive tape crosswise and then trimming the spliced fronts. However, this known procedure has the disadvantage that it can in no way ensure that a true alignment of the two spliced webs or fabrics is achieved. Any misalignment upstream of the system reflect in operation problems throughout the system and may be the cause for irreparable damage to the fabric or web to be treated.

SUMMARY OF THE INVENTION

It is an object of this invention to provide a system for processing fabrics or webs continuously, whereby splices between two sections of a material to be processed can be made rapidly such that, on completion of the splice, the fabrics or webs are correctly aligned the one after the other.

Another object of this invention is to provide a processing system having a high hourly output rate and requiring the supervision of a single operator.

A further object of this invention is to provide a processing system arranged to subject the fabric or web being processed to an evenly applied pull all along the processing path, thereby no undesired stresses are imposed on the fabric or web being treated or already treated.

According to the present invention there is provided a system for processing fabrics or webs continuously, which comprises, laid out sequentially, a web or fabric roll unwinding unit, a station of application for a coating or impregnating material to the web or fabric from the unwinding unit, a treatment kiln for the coated or impregnated web or fabric being fed from the application station, at least one multiple deflector and take-up roller set upstream of the application station and downstream of the treatment kiln, and a winding unit for the processed web or fabric, wherein said unwinding unit includes a splicing assembly provided with a pair of parallel hinge lids or flaps journalled about a common axis or parallel axes at the adjoining ends thereof, whereby they can be brought to overlie each other, and each having, at the distal end thereof, a working front, each hinge lid being adapted to receive, at its working front end, web or fabric from a respective roll to be unwound and to convey it into a slit between the two hinge lids, holding means on each hinge lid operative to hold down fabric or web on the working front of a respective one of said hinge lids, trimming means operative to sever and trim, at the working front of a respective one of said hinge lids, the trailing section of an unwound roll of web or fabric and, at the working front of the other of said hinge lids, the leading section of a roll to be unwound, actuator means effective to selectively pivot the hinge lid carrying the trailing section of the unwound roll to take the working front thereof close against the working front of the other hinge lid, thereby the trailing section of the unwound roll of fabric or web can be brought to overlap the leading section of the fabric or web to be unwound, and presser/heater means arranged to act on the overlaid leading and trailing sections of web or fabric to splice them together under heat and pressure application.

BRIEF DESCRIPTION OF THE DRAWINGS

Further aspects and advantages of this invention will better appear from the following detailed description of a preferred embodiment thereof, given herein by way of illustration and not of limitation with reference to the accompanying drawings, where.

DESCRIPTION OF THE PREFERRED EMBODIMENTS

Figure 1:
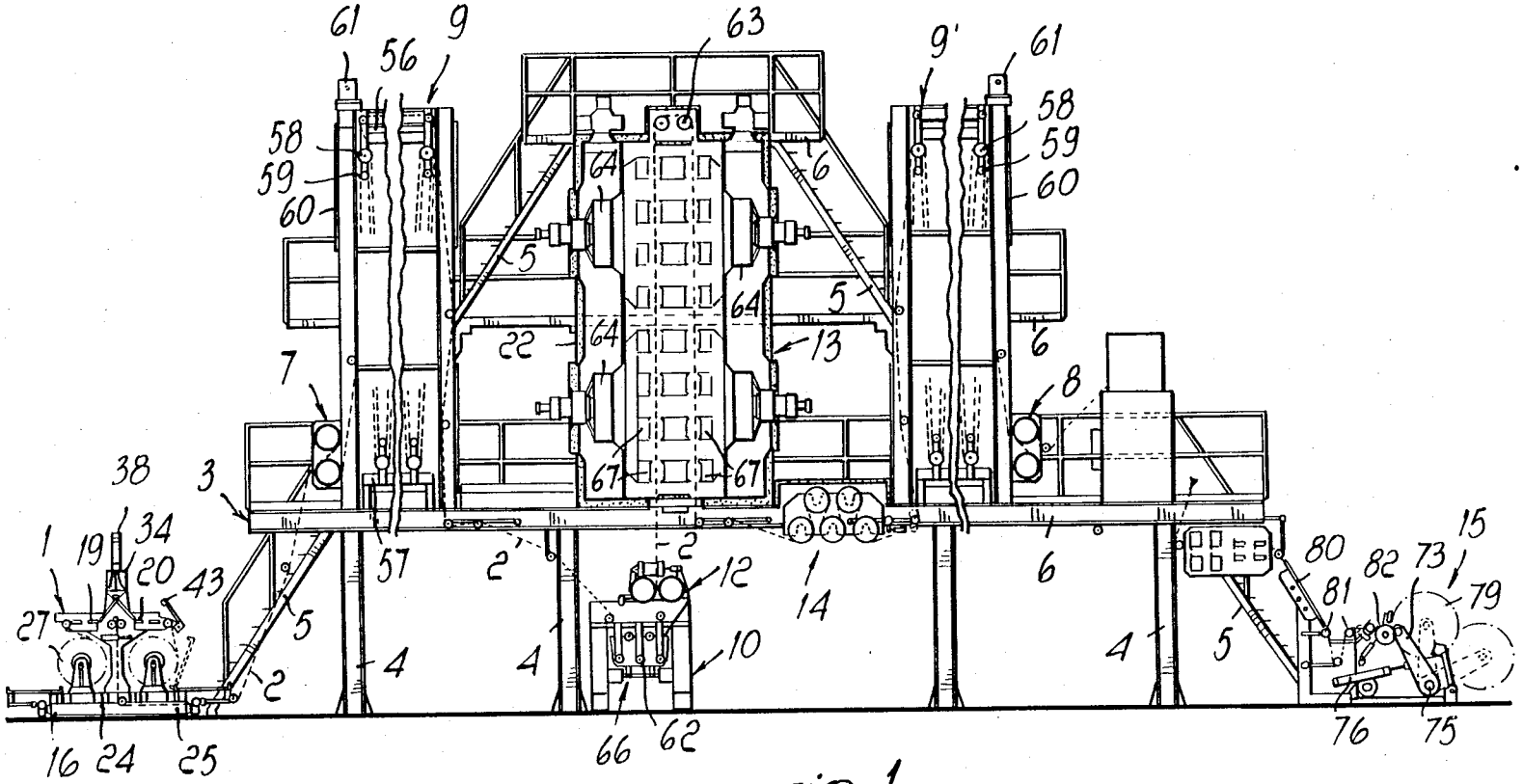
FIG. 1 is a view in side elevation and in section of a continuous processing system according to the invention.

Making reference first to FIG. 1 of the drawings, it may be seen that the system shown therein comprises an initial unwinding/splicing unit 1 from which a fabric or web 2 to be processed is transferred to a group of processing stations mounted on or at a supporting frame, generally indicated at 3, which rests on the floor through pairs of pillars or uprights 4 and is provided on two sides thereof with access ladders 5 and inspection walkways 6 arranged on three levels. At the inlet and outlet ends of the frame, the web or fabric 2 passes through a pair of stretch rollers, indicated at 7 for the inlet end and 8 for the outlet end of the frame 3. Close against the pair of rollers 7, there is provided a first multiple roller set or stand 9, whence the fabric or web 2 is transferred to a processing material application station 10 equipped with a foulard unit 12. The coated or impregnated web 2 from the foulard unit 12 is delivered into a hot air kiln 13, wherein the web 2 is caused to follow an upward sloping path and a downward sloping path. From the kiln 13, the processed web is passed to a set of finishing rolls 14 inside which a hot fluid such as oil is circulated to provide for hot operation of the rolls. From the finishing rolls 14 the processed web is passed to a roller set or stand 9' quite similar to the roller set 9, and then fed into a winding unit 15.

The unwinding/splicing unit 1 is shown in more detail in FIGS. 2 to 7.

Figure 6:
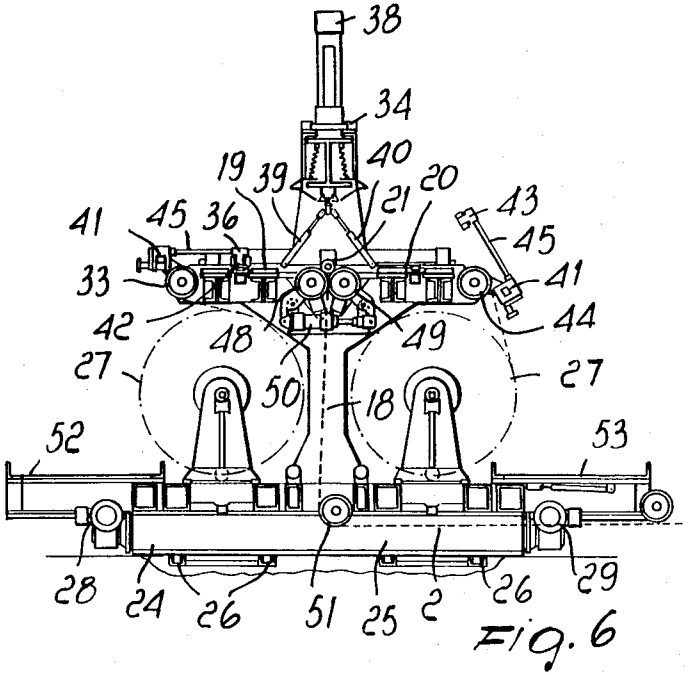
FIG. 6 is a side view showing, in section and on reduced scale, the unwinding/splicing unit of FIG. 5.
Figure 7:
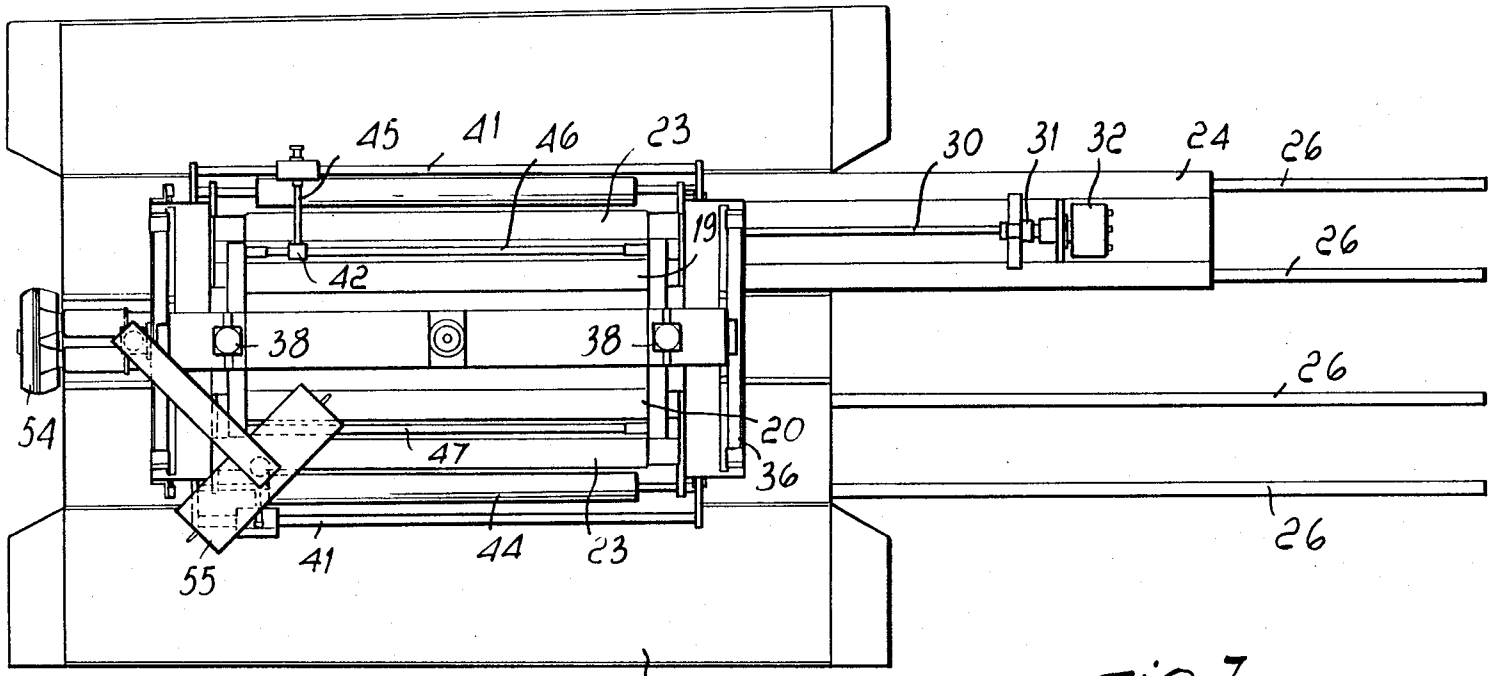
FIG. 7 is a top plan view of the unwinding/splicing unit of FIG. 5.

It comprises a box-like bed 16 from which there extend upwards two lateral sides 17 and 18 supporting two parallel hinge lids or flaps 19 and 20 mounted for pivotal movement about an axis 21 (FIG. 6) at their adjoining ends, where they define a slit (not shown) for the fabric or web 2 to pass through. The opposite end, i.e. the free or distal end, of the hinge lids 19 and 20 forms the working front or edge 23 of each hinge lid. With this arrangement, the working fronts 23 are located, with the hinge lids or flaps in their home positions, on opposite sides with respect to the pivot axis 21, and laid, for example, on a common horizontal plane (FIGS. 6 and 7).

Figure 5:
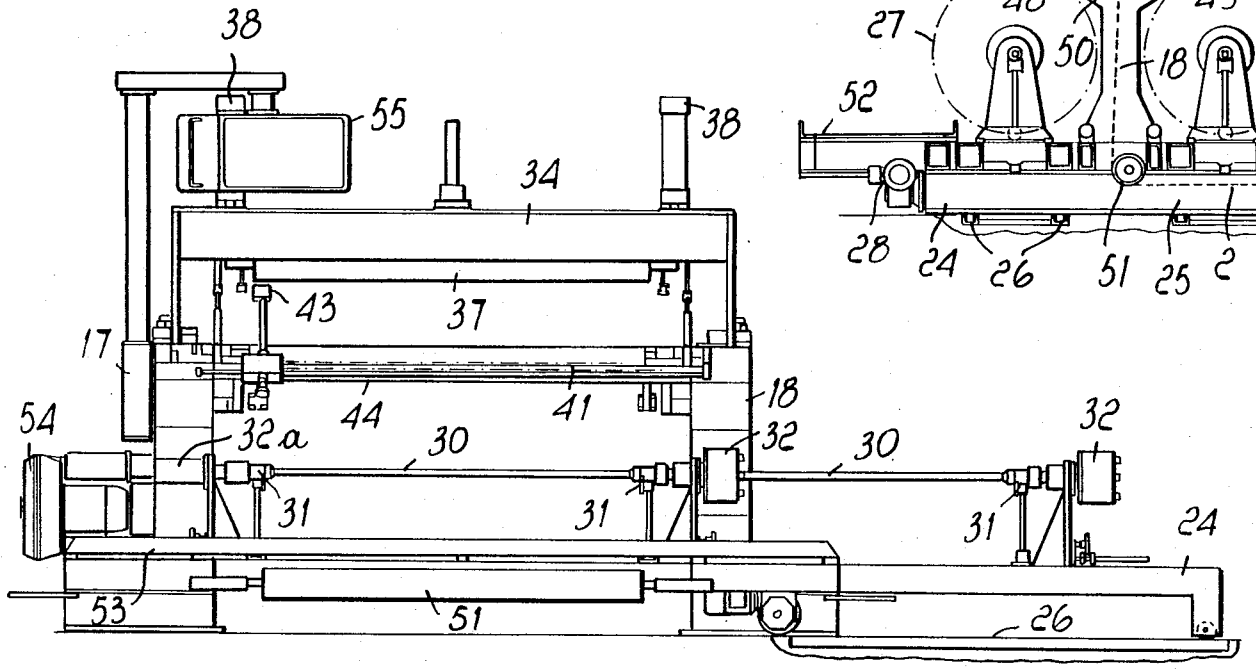
FIG. 5 is a front elevation view on an enlarged scale of the unwinding/splicing unit.

Provided at each front 23 in the bed 16 is a respective carriage 24,25, which is mounted to move along floor-mounted runways or rails 26 extending beyond either of the lateral sides 17,18, whereby the carriage can be withdrawn sideways out of the bed 16. The carriages 24,25 are each arranged to accommodate and rotatably support each one roll 27 of fabric to be unwound. To place a roll 27 on a carriage, the carriage must be drawn out of the bed 16, such as automatically by means of a respective hydraulic or pneumatic jack 28 or 29, so that the roll can be laid, by using a mandrel 30 inserted therethrough, in two opposite support seats 31 provided on the carriage. One of the seats 31 is associated with an automatic or braking device 32 for the mandrel 30, and the other seat with an ejection jack 32*a* for ejecting the mandrel on completion of the winding operation (FIGS. 5 and 7).

The unwinding/splicing unit 1 is provided at the top with a crosspiece 34 carried slidably on the lateral sides 17,18 such that it can be moved to and from each working front 23, for example, by two side-mounted double-acting jacks 35 and 36. The crosspiece 34 carries on its bottom face a metal bar 37 (FIG. 5) provided with internally mounted heater means (not shown), such as one or more resistance heaters. The bar 37 can slide on vertical guides (not shown in the drawing), and is controlled by a pair of jacks 38. To the crosspiece 34 there is also connected one end of two pairs of opposite jacks, 39 and 40, having their other end attached to a respective hinge lid or door 19,20.

Externally of each working front 23 of the hinge lids, a cutter 42,43, carried on a respective arm 45, is slidably supported on a respective cross guide 41. The arms 45, in their rest position, are upright to hold their cutter raised off the adjacent hinge lid or door, whereas in their working position they would move the cutter down to act along a respective straight work path 46,47 provided on the hinge lid beyond the working front of the latter and extending parallel to the pivot axis 21 of the hinge lids.

In the proximity of each guide 41, there is also provided a turn-around roller or cylinder 33,44 whereon the fabric or web 2 from the underlying roll 27 turns prior to move over the hinge lid close to it. From the hinge lid or flap, 19 or 20, the web or fabric 2 passes through the slit delimited between the hinge lids and then between two pinch rollers 48,49 located under the slit and arranged to be clamped together and moved away from each other by jacks 50. From the rollers or cylinders 48,49, the web or fabric 2 turns around a cylinder 51 placed in the bed 16 is directed to the rollers 7 in the frame 3.

Advantageously, at the two opposite fronts of the unwinding/splicing unit 1, there is formed on the bed 16 a respective access footboard 52,53 for an operator to use whenever a splicing operation is to be performed. Such an operation is diagrammatically illustrated in sequence in FIGS. 2 to 4. During a normal unwinding operation, web or fabric 2 from one of the rolls 27, e.g. the right-hand one as viewed in FIG. 2, passes over the turn-around roller 44, and then over the hinge lid or flap 20, into the slit between the hinge lid pair, to turn around the roller 49 near the slit and the roller 51 in the bed 16.

As the roll 27 is near exhausted, or whenever the feed from the right-hand roll 27 is to be discontinued to continue the feed from the left-hand roll, the operator will move to the footboard 52, and take the leading end of the left-hand roll 27 to pass around the roller 33 and over the working front 23 of the hinge lid or door 19. The working front 23 of each hinge lid consists of a box-like body which extends all along the front of the respective hinge lid and is formed with a plurality of perforations in communication with a suction means, such as a motor-driven aspirator, generally indicated at 54 in FIGS. 5 and 7. The control sequence is such that, when the operator presses a pushbutton on the control panel 55, a vacuum is created at the working front of the hinge lid 19 which holds down the end of the fabric or web carried thereon. Then the operator actuates, either manually or automatically, the cutter 42, which will move into its operative position and effect a clear trimming out through the material along its work path 47 directly adjoining the working front 23 of the hinge lid 19. After moving the cutter 42 away, the operator will possibly apply an adhesive tape, e.g. of a thermo setting material, on the web area held down on the working front 23. The unwinding/splicing unit is now ready to complete a splice automatically.

Figure 2:
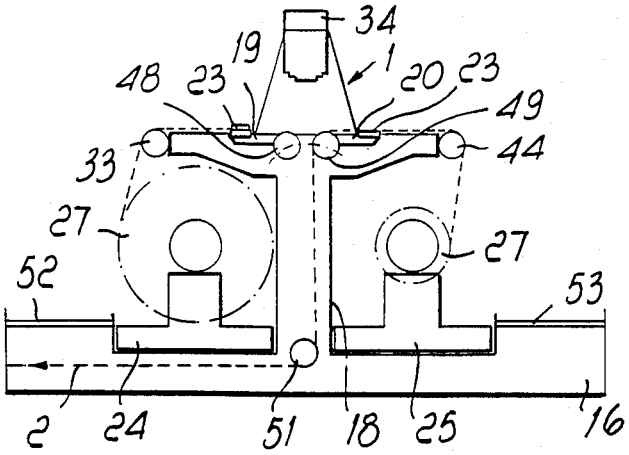
FIGS. 2 to 4 are schematic side views showing each a different operative step of the unwinding/splicing unit placed upstream of the system of FIG. 1.
Figure 3:
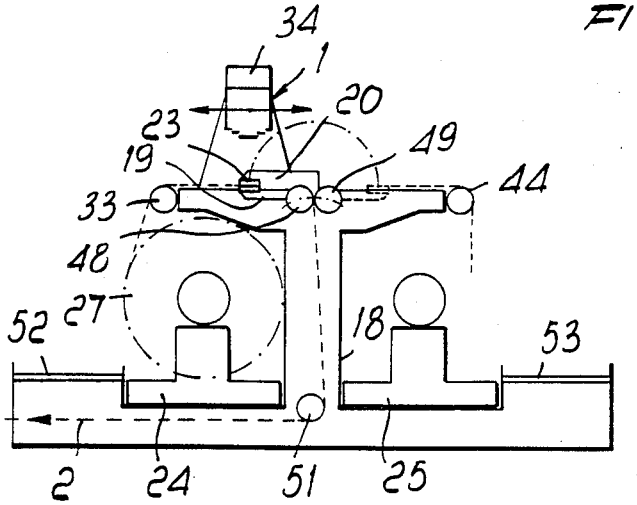
Figure 4:
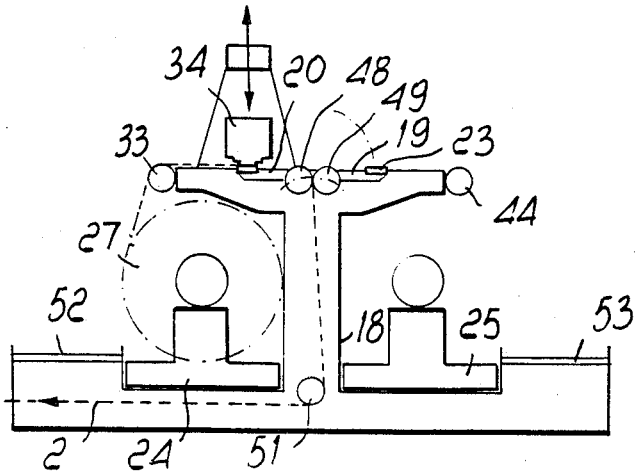

On exhausting the right-hand roll 27, or at any rate, on the operator occupying the footboard 53 and operating a specifically provided pushbutton, the jacks 50 will be actuated to bring the rollers 48 and 49 together, whereby the web 2 being unwound is pinched while at the same time the rollers 7 are caused to clamp together on the frame 3 to operate, as explained hereinafter, the take-up roller set 9 and keep the remainder of the system in operation. Then, the cutter 43 will operate in much the same way as the cutter 42 to sever the web 2 in a truly normal direction to its feed direction. Operating the jacks 50 to clamp the rollers 48 and 49 together also brings into operation the suction means associated with the working front of the hinge lid 20, which means had already been operative to hold the web or fabric 2 perfectly adherent on the hinge lid 20 during the cut. At this stage, the machine performs, either automatically or on command by the operator, a displacement movement of the upper crosspiece 34 toward the hinge lid 19, while causing at the same time, through the action of the jacks 40, the hinge lid 20 to be tilted onto the hinge lid 19 (FIG. 3) dragging therealong the trailing end of the web or fabric 2 of the exhausted roll. Once the two fronts 23 have become aligned together, the operation sequence of the machine contemplates that suction or vacuum within the working front of the hinge lid 20 be discontinued, and that the hinge lid 20 be then returned automatically to its home or inoperative position. Thereafter, the jacks 38 are operated, which cause the bar 37 to move down onto the lapped trimmed edges of the webs or fabrics to be spliced, which are now in an overlapping state at the working front 23 of the hinge lid 19. The bar 37 is maintained at a suitable temperature which will depend on the nature of the materials to be spliced and of the sealing tape employed, and is arranged to exert both a thermal action and a mechanical action, since it will heat the edges to heat weld them together while applying a pressure thereon for a while (FIG. 4). Thereafter, the bar 37 is raised and the crosspiece 34 returned to the center position as shown in FIG. 2. With the crosspiece 34 returned to its center position, the rollers 48 and 49, as well as the rollers 7, are released, and unwinding is resumed which now takes place from the left-hand roll 27, over the roller 33 and the hinge lid 19, around the roller 48, and back around the deflector roller 51 in the bed 16.

As one can appreciate, the unwinding/splicing unit 1 makes it possible to semiautomatically splice two webs or fabrics in a most rapid and accurate manner, since the spliced edges are cut to size prior to splicing, whereby once the suture has been accomplished it is no longer necessary, as in the past, to resort to some manual means, e.g. scissors, to trim the edges. Moreover, the cut performed by one cutter 42 or 43 is always a neat one congruent with the cut performed on the other cutter, so that on completion of the splice, the two spliced webs or fabrics will be always aligned true to each other; this is quite of importance in that stretching effects can thus be avoided which would result in the formation of tears in the webs or fabrics due to the web or fabric setting after splicing.

From the pinch rollers or cylinders 7, the material 2 is delivered to the roller set or stand 9, which is formed of two carriages, an upper one 56 and a lower one 57, each of which carries a plurality of turn-around rollers or cylinders arranged in pairs 58 and 59. The carriages 56 and 57 are movably mounted along a vertical frame 60 and driven by a geared motor 61 and drive chains, not shown, thereby moving away from one another on starting the system to pick up a large amount of web material 2, and then gradually moving near, such as during a splicing operation, to compensate for the short duration stop of the unwinding/splicing unit 1 for replacing an unwinding roll 27. From the roller set 9, the material 2 passes through a multiple processing vat 66 filled with a suitable liquid processing material, such as a resin, and then turns around a multiplicity of rollers or cylinders 62 before going through the foulard 12, which is effective to squeeze out the excess impregnating liquid material before the web or fabric 2 enters the drying and/or curing kiln 13.

Figure 8:
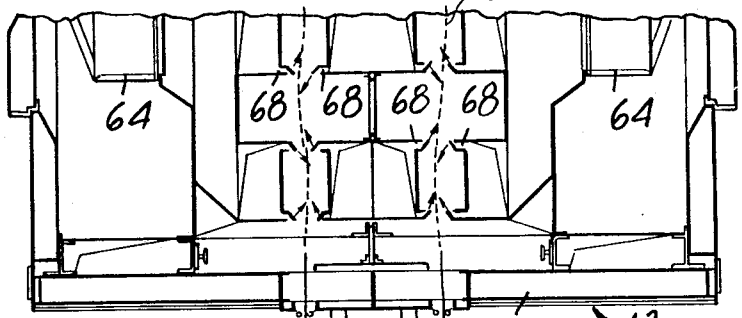
FIG. 8 is a fragmentary detailed view on an enlarged scale of the treatment kiln in the system of FIG. 1.
Figure 9:
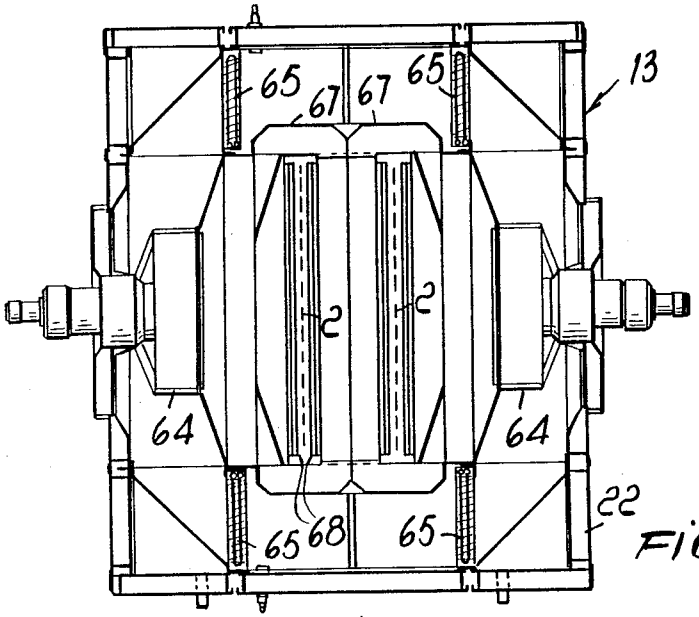
FIG. 9 is an enlarged scale top view of the treatment kiln in the system of FIG. 1.

The kiln 13, as best shown in FIGS. 1 to 8 to 10, has outer walls 22 which are heat insulated by means of a suitable thermally insulating material, e.g. glass wool. Two paths are delimited on its interior, namely a forward path and a return path, reversal being provided at the top by two turn-around rollers 63. Close to both forward and return paths for the material 2 impregnated with resin, there are provided two pairs of electric fans 64, which supply hot air from banks of radiators 65, such as electric or diathermal oil radiators, located within the kiln walls, and a plurality of manifolds 67 spaced apart at regular intervals along both the up and down paths of the material to be processed and acting on the latter through respective hot air outlets 68. The outlets 68 are arranged in juxtaposed pairs on opposite sides of the web or fabric, the outlets in each pair being so oriented as to direct an air stream in substantially opposite directions to each other (FIG. 8). With such an arrangement of the hot air outlets 68, the web or fabric 2 takes a roughly wavy configuration through the kiln 13 without contacting the outlets 68 themselves, i.e. it arranges itself for optimum utilization of the hot air jet action.

Figure 11:
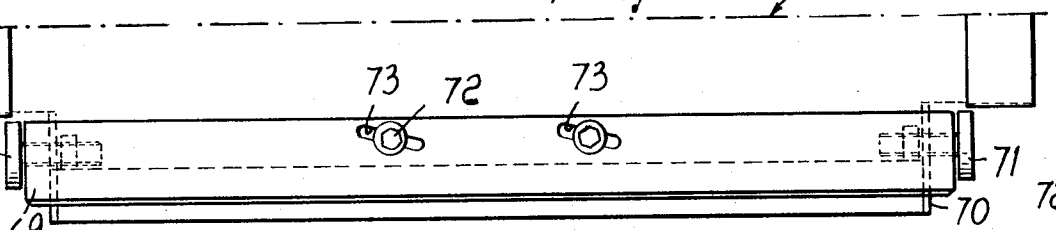
FIG. 11 is a plan view of a hot air delivery outlet in the treatment kiln.
Figure 13:
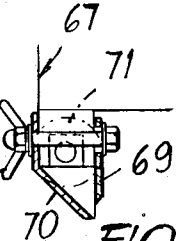
FIG. 13 is a view similar to FIG. 12 showing a modified embodiment of the delivery outlet of FIG. 11.
Figure 12:
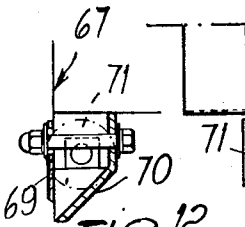
FIG. 12 is a sectional side view of the delivery outlet of FIG. 11.

More specifically, and as shown in FIGS. 11 to 13, each outlet fitting includes two lips 69 and 70 adapted to issue air in laminar form. The gap, and to some extent the orientation, between the lips 69 and 70 may be adjusted by means of two side-mounted knobs 71, which are adapted to longitudinally shift, for example, the upper lip 69, the lip being secured by wing screws or bolts 72 at respective slots 73 inclined on the threading axis of the knobs 71.

On leaving the kiln 13, the processed web 2 is taken first to the finishing cylinders 14 and then to the second roller set or stand 9', having the same construction as the roller set 9. Lastly, the web or fabric 2 is delivered to the winding unit 15.

The latter is illustrated in more detail in FIGS. 14 to 18. As may be seen, the winding unit 15 has a pair of side support arms 73 and 74 keyed at the bottom to a pivot axle 75 around which they can pivot by the action of jacks 76. Upwardly the arms 73 and 74 support a winding mandrel 78, e.g. similar to the unwinding mandrels 30, around which the processed web or fabric 2 is wound into a roll of processed fabric 79. The mandrel 78 on the arms 73 and 74 is set in rotation by a geared motor 77 located on one side of the winding unit and a chain drive (not shown) inside one of the arms, e.g. the arm 73.

Prior to reaching the mandrel 78, the web or fabric 2 is delivered to a display panel 80 which makes it possible to display any defects, or at least to estimate the quality of the finish of the processed material, and over a plurality of turn-around rollers generally indicated at 81, before reaching a support roller 82. The latter will bear on the roll 79 being formed, and carries at the top a crosspiece 83 which carries a back sectional member 84. The crosspiece 83 is actuated by a jack 85 to take the sectional member 84 to contact the web 2 and push it against an electric resistance wire 86 supported on the other side of the web 2, e.g. below it. After the jack 76 has pushed the arms 73 and 74, and hence a completed roll 79, away from the roller 82, the web 2, being pressed by the sectional member 84 against the wire 86, will be cut through.

Figure 16:
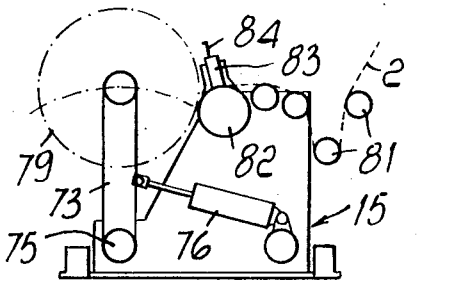
FIGS. 16 to 18 are schematic side views, taken from the opposed side with respect to the view in FIG. 15, which illustrate successive operating phases of the winding unit shown in FIGS. 14 and 15.
Figure 17:
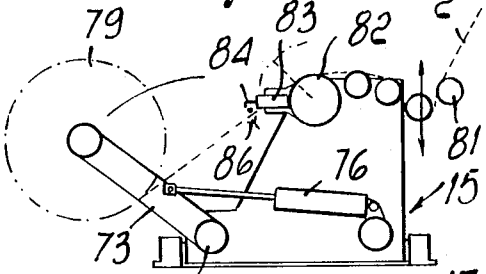
Figure 18:
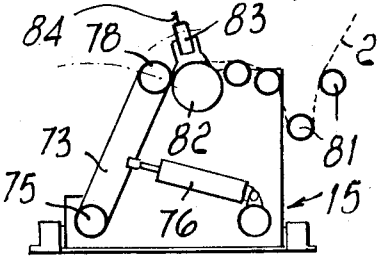
Figure 10:
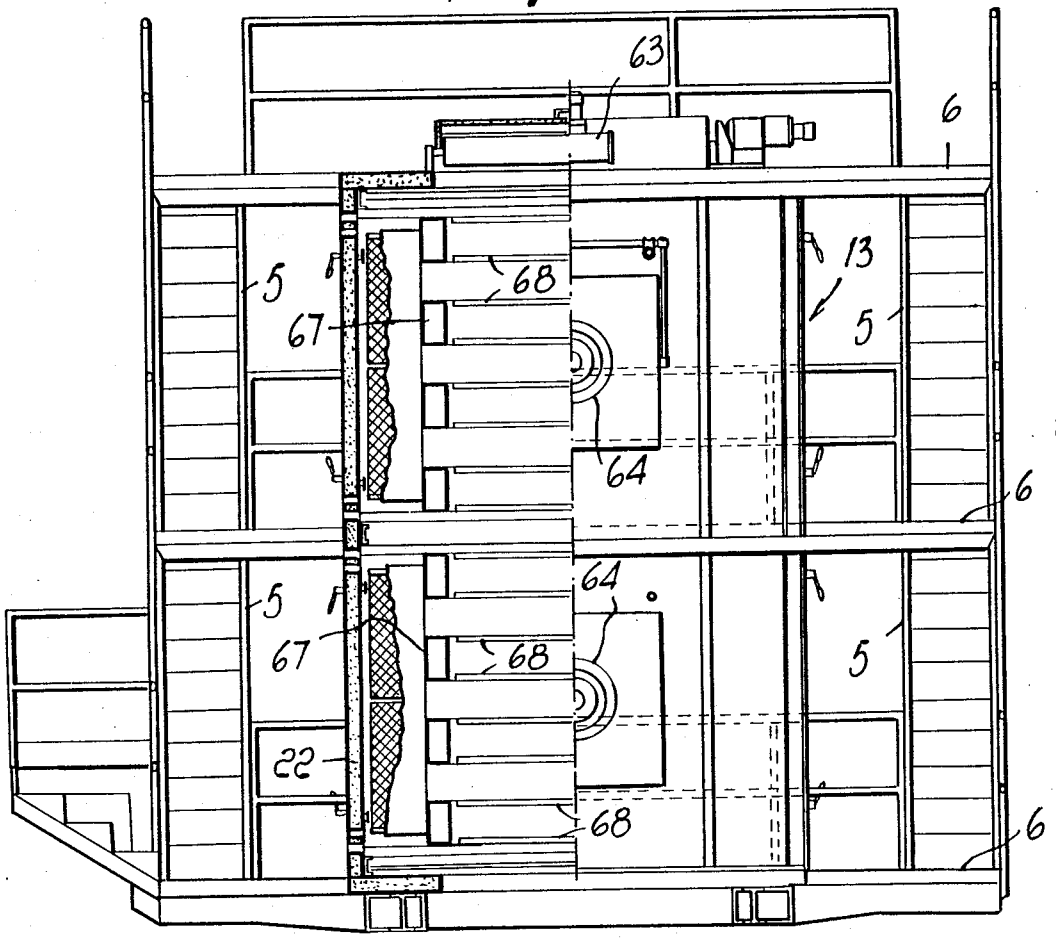
FIG. 10 is a front elevation view, with portions cut away, of the treatment kiln of FIGS. 1, 8 and 9.
Figure 14:
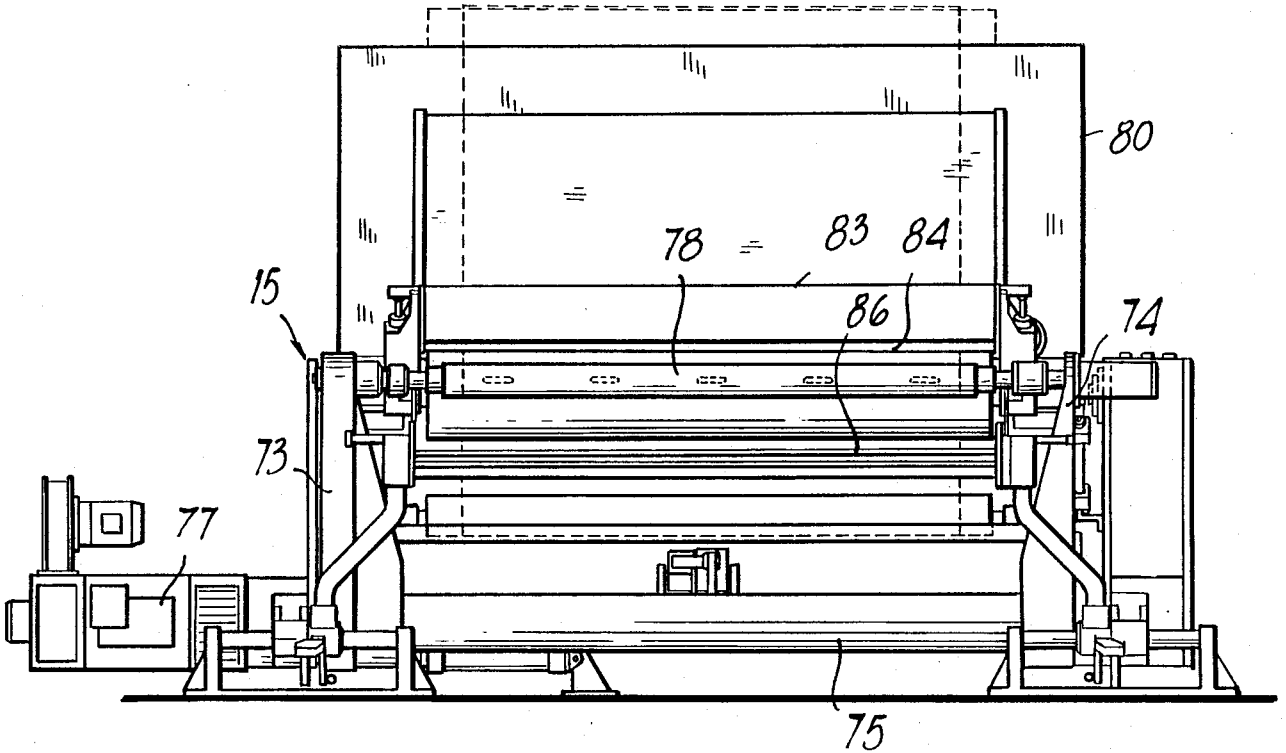
FIG. 14 is an enlarged scale front elevation view of the final winding unit for the processed web or fabric.
Figure 15:
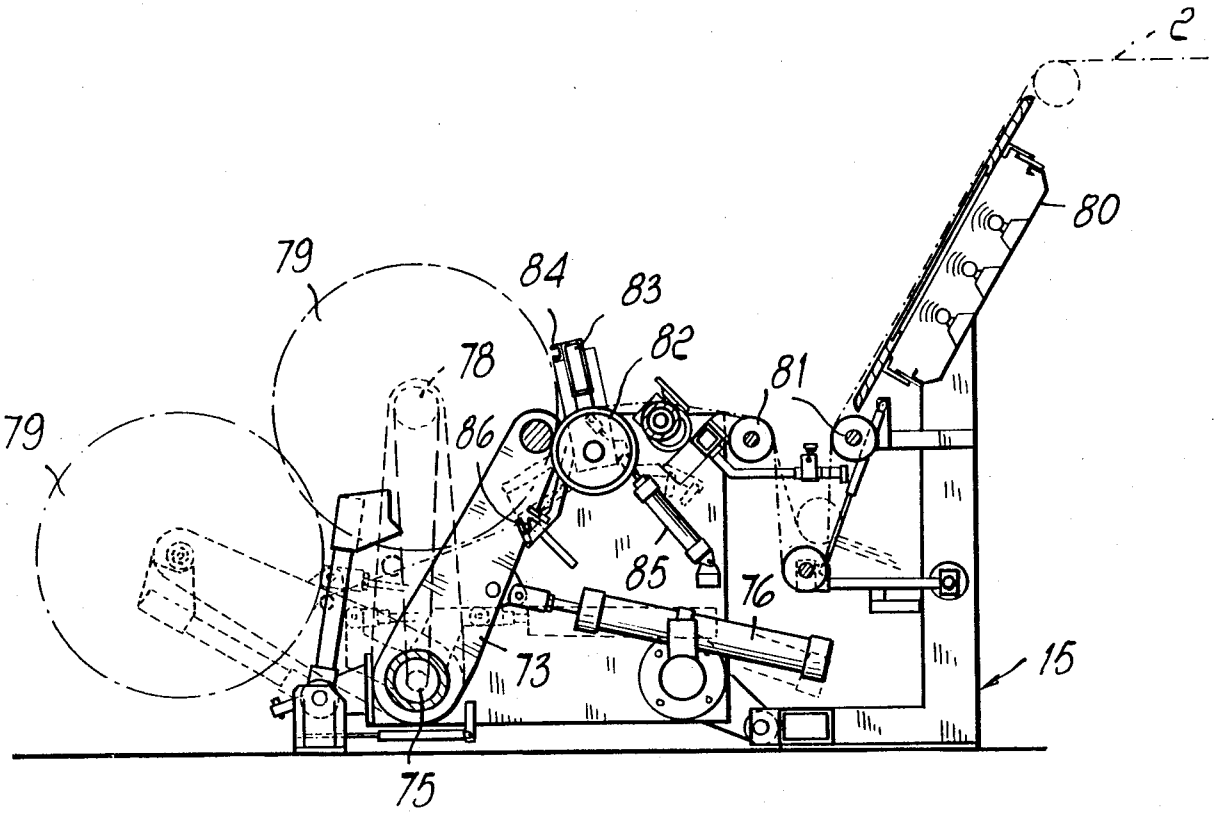
FIG. 15 is a sectional side view of the winding unit of FIG. 14.

The operating sequence for the machine 15 is clearly illustrated by FIGS. 16 to 18.

It will be appreciated that the system herein is suitable for achieving all of the object set out in the preamble, and can operate automatically under the supervision of a single operator. Advantageously, its operation can be centralized and controlled by a computer (not shown) which makes it possible inter alia to vary the rate of travel of the web or fabric through the system, as well as to variously programme according to requirements both the stay times at the application station 10 and in the kiln 13, and the pull applied to the web or fabric being processed through the system. Moreover, the system disclosed is susceptible to many modifications and changes without departing from the scope as defined in the appended claims. Thus, as an example, instead being severed by the hot wire 86, a web or fabric being processed could be severed by some other suitable cutting means, such as a cutter. The system, may also be utilized for neutralization operations (e.g. glass fiber fabric) for heat-thermal of dressings, and for fabric finishing or coating processes or some other kinds of application of resins to web materials, such as paper.

We claim:

1. A system for processing fabrics or webs continuously, which comprises, laid out sequentially, a web or fabric roll unwinding unit, a station for application of a coating or impregnating material to the web or fabric from the unwinding unit, a treatment kiln for the coated or impregnated web or fabric being fed from the application station, at least one multiple deflector and take-up roller set upstream of the application station and downstream of the treatment kiln, and a winding unit for the processed web or fabric, wherein said unwinding unit includes a splicing assembly provided with a pair of parallel hinge lids journalled about a common axis or parallel axes at adjoining ends thereof, whereby they can be brought to overlie each other, and each having, at the distal end thereof, a working front, each hinge lid being adapted to receive, at its working front end, web or fabric from a respective roll to be unwound and to convey it into a slit between the two hinge lids, holding means on each hinge lid operative to hold down fabric or web on the working front of a respective one of said hinge lids, trimming means operative to sever and trim, at the working front of a respective one of said hinge lids, the trailing section of an unwound roll of web or fabric and, at the working front of the other of said hinge lids, the leading section of a roll to be unwound, actuator means effective to selectively pivot the hinge lid carrying the trailing section of the unwound roll to take the working front thereof close against the working front of the other hinge lid, thereby the trailing section of the unwound roll of fabric or web can be brought to overlap the leading section of the fabric or web to be unwound, and presser/heater means to act on the overlapping leading and trailing sections of web or fabric to splice them together under heat and pressure application.

2. A system according to claim 1, wherein said holding means comprise at least one perforated section along each working front of the hinge lids and suction means adapted to selectively create a vacuum at said perforated sections to hold the web or fabric thereon.

3. A system according to claim 1, wherein said presser/heater means comprise a frame straddling the hinge lids and being mounted movably for shifting to and from the working front of each hinge lid, a metal bar carried on said frame and confronting said hinge lids, means for heating said bar and bar actuating means adapted to press the bar against and remove it from the working front of the hinge lids.

4. A system according to claim 1, wherein said kiln comprises means for heating air inside it, an orderly succession of juxtaposed hot air blowing outlet pairs defining therebetween a drying or curing path for the web or fabric impregnating or coating material and being oriented to direct hot air in mutually opposed directions, and blower means for delivering under controlled pressure the air heated by the heater means to said blowing outlets.

5. A system according to claim 4, wherein each said blowing outlet comprises moving and stationary deflector lips lying parallel to each other, the moving lip having two or more slots for retention and sliding relatively to the stationary lip, said slots being inclined on the parallel relationship direction of the lips, and adjustment means operative to shift the moving lip along its slots to controllably move it to and from the stationary lip, thereby regulating both the flow rate and direction of delivery of the hot air issuing from the respective outlet.

6. A system according to claim 1, wherein said winding unit comprises two arms supporting a roll winding mandrel and being journalled at the bottom, actuator means for said supporting arms, a roll contacting cylinder, and characterized in that it further comprises a movable supporting structure adapted to act in the proximity of the contact cylinder, severing means for severing a web or fabric directed to a roll being formed on the winding mandrel when said actuator means moves the roll away from said contacting cylinder.

7. A system according to claim 6, wherein said severing means comprise an electric resistance wire located on one side of the web or fabric and a registering element located on the opposite side of the web or fabric and being carried on said movable support structure for pushing it against said electric resistance wire when said actuator means moves the roll away from said support cylinder.

8. A system according to claim 6, wherein said severing means comprise a cutter.

9. A system according to claim 6, wherein said movable support structure is journalled at the ends and astride said contacting cylinder.

* * * * *